US005263300A

United States Patent [19]

Plent et al.

[11] Patent Number: 5,263,300

[45] Date of Patent: Nov. 23, 1993

[54] DEVICE FOR INCLINING AND STACKING FLAT IN A BOX, IN PARTICULAR LETTERS EXITING FROM A SORTING MACHINE

[75] Inventors: Christian Plent, Bourg les Valence; Bernard Constant, Beaumont les Valence; Michel Divoux, Bourg de Peage; Pierre Campagnolle, Beaumont les Valence, all of France

[73] Assignee: Compagnie Generale d'Automatisme CGA-HBS, Bretigny sur Orge, France

[21] Appl. No.: 875,421

[22] Filed: Apr. 29, 1992

[30] Foreign Application Priority Data

May 3, 1991 [FR] France ..... 91 05462

[51] Int. Cl.[5] ..... B07C 5/36

[52] U.S. Cl. ..... 53/244; 53/255; 209/900

[58] Field of Search ..... 53/235, 255, 244; 209/900; 193/8, 46; 271/297, 2, 186

[56] References Cited

U.S. PATENT DOCUMENTS

| | | | |
|---|---|---|---|
| 2,115,805 | 5/1938 | Fuller | 198/42 |
| 2,912,925 | 11/1959 | Rabinow | 209/900 X |
| 3,283,472 | 11/1966 | Hostetler | 53/244 X |
| 4,047,712 | 9/1977 | Burkhardt et al. | 209/900 X |
| 4,539,794 | 9/1985 | Azzaroni | 53/244 X |
| 5,109,987 | 5/1992 | Daboub et al. | 271/186 X |

FOREIGN PATENT DOCUMENTS

| | | |
|---|---|---|
| 2191541 | 2/1974 | France . |
| WO8809224 | 12/1988 | PCT Int'l Appl. . |

*Primary Examiner*—James F. Coan

*Attorney, Agent, or Firm*—Sughrue, Mion, Zinn, Macpeak & Seas

[57] ABSTRACT

The present invention relates to a device for inclining and stacking flat in a box flat objects, especially letters exiting particularly from a sorting machine, in which the letters are fed vertically orientated and are released above the device. It comprises a chute with a concave main slide and deviating surface and an associated convex secondary surface, the latter being continued by a flap hinged about a transverse horizontal axis and with its lower edge in contact with the letters stacked in the box.

10 Claims, 2 Drawing Sheets

15
3'
3
1
2
2'
IV
V
A
4
4'
5
7
7'
8
9
10
11
16
17
18
19
20

DEVICE FOR INCLINING AND STACKING FLAT IN A BOX, IN PARTICULAR LETTERS EXITING FROM A SORTING MACHINE

The present invention relates to a device for inclining and stacking flat in a box flat objects, especially letters exiting particularly from a sorting machine, in which the letters are fed vertically orientated and are released above the device, which comprises a chute with a concave main slide and deviating surface and an associated convex secondary surface.

BACKGROUND OF THE INVENTION

More particularly, in such a sorting machine, each letter whose destination has already been determined, is positioned vertically in a pocket. The pockets are fed on a carousel and their bottoms are opened above the output unit sufficiently to release each letter. At this output unit the letters are stacked flat in a box which serves for their transport to subsequent processing.

The device for inclining and stacking flat objects thus has to receive the letter vertical and deflect it so that it arrives horizontally in the box, where the letters should be stacked flat in a satisfactory manner. The deflection and stacking must be effected correctly, regardless of the rigidity of the letter, which may be a relatively flexible single sheet such as a leaflet or a relatively stiff magazine, and of which the material forming the envelope of the letter may be of various kinds, in particular paper or a plastics film.

Moreover, the device should observe limitations on space. In the invention the difference in height between the bottom of the pocket and the bottom of the box is less than or equal to about 600 mm.

Finally, it should avoid any jamming of the letter in the device with resultant clogging. In fact, at present "sticking" effects are observed in such devices, a letter sticking to the deflecting surface because of a kind of suction effect during the descent of the letter against the surface.

SUMMARY OF THE INVENTION

In order to overcome these problems, according to the invention the convex secondary surface is continued by a flap hinged about a transverse horizontal axis and with its lower edge in contact with the letters stacked in the box.

The required deflecting and stacking properties are thus obtained.

The main surface is preferably formed by a perforated metal sheet sealed on the back by a film, which may be of plastic or metal. This avoids excessive adhesion, resulting from aerodynamic effects which occur between the letter and the main surface and which tend to drive out the air from this interface. Through these means a multitude of small reservoirs of air are provided in the main surface, adapted to form an air cushion supplying the interface during the sliding of the flat object on the surface, in order to limit the force of adhesion between the object and the surface.

In another embodiment, these reservoirs of air may be obtained by embossing pockets in the sheet metal forming the main surface.

In order to improve sliding properties, the sheet metal is coated at least partially with polytetrafluoroethylene.

In a preferred design the flat flap is freely hinged to the secondary surface and has a stop position of maximum inclination in which its lower edge is adjacent the bottom of the box. In this way the flap serves both to guide the letter emerging from the chute and to brake it to rest and also to ensure that it stacks correctly on the bottom of the box or on the letters already stacked.

In order to stop filling and to interrupt the feed of letters to the box at this time, a mechanical tongue sensor is located adjacent the upper edge of the flap for detecting the maximum filling position of the box.

According to another feature, the rear and front edges of the flap are shaped, the minimum width of the flap being at the level of its lower edge, to form a lifting abutment edge acting against the rear wall of the box when the latter is removed or put in place. This avoids the need for a command to raise the flap to a high position in order to withdraw the full box or put an empty box in place. Because of its inclined shape, the front or rear edge slides on the rear wall of the box, externally or internally, so that the flap is raised automatically.

As a safety measure, to stop use of the output unit should a letter jam, the device comprises a photoelectric sensor detecting the presence of a letter at the output of the chute.

According to a preferred embodiment, the sensor is fixed on the main surface on its convex side.

According to a constructive detail, an output assembly is provided for forming a device such as is described above and it is formed by a main surface, an adjacent, non-associated secondary surface and components fixed thereto.

To form a module of output units, such assemblies are fixed side by side, forming the chutes therebetween.

BRIEF DESCRIPTION OF THE DRAWINGS

An embodiment of the invention is described by way of example with reference to the accompanying drawings, in which.

DETAILED DESCRIPTION

Figure 1:
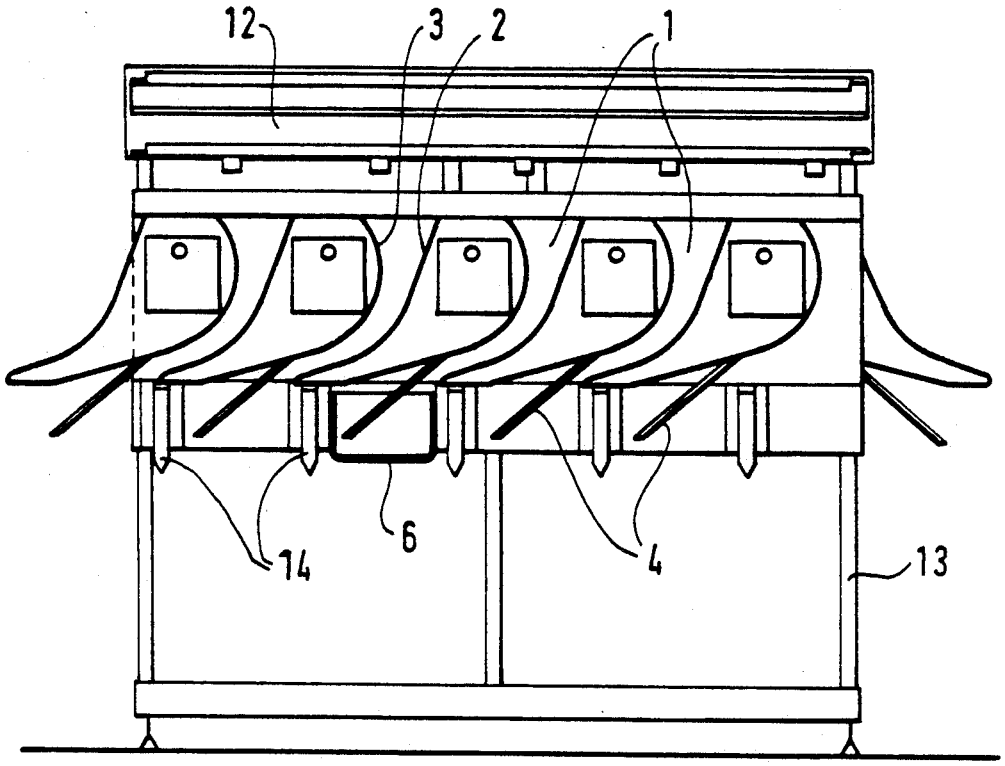
FIG. 1 is a front view of a module of a sorting machine comprising devices embodying the invention.
Figure 2:
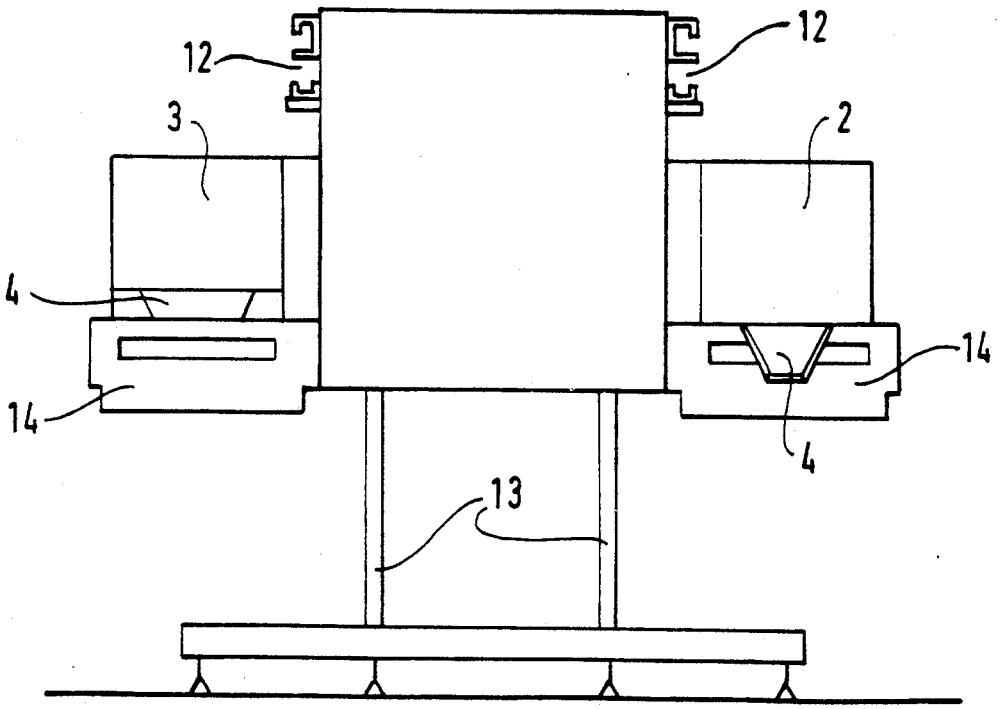
FIG. 2 is a side view corresponding to FIG. 1.

FIGS. 1 and 2 are general views of devices embodying the invention arranged at the output of a sorting machine. A module comprises five output units, each comprising a chute 1 into which are released letters contained in pockets opening at the bottom and fed along the guideway formed by the rails 12. The modules are juxtaposed and end units fitted, the path of the pockets being as in a carousel.

The module comprises a frame 13 and support structures 14 for boxes 6, of which one only is shown, The box 6 is retained by conventional means, it being put in place by pushing it into its receptacle and being withdrawn by pulling it out of the latter. Sorted into their respective boxes 6, the letters may be transported to undergo their subsequent processing.

The chutes 1, which receive the vertical letters at their upper parts, are each formed by a concave main surface 2 and a convex secondary surface 3, continued by a flap 4 hinged about a transverse horizontal axis. In the low position, the flaps 4 are in abutment with their lower ends adjacent the bottom of the boxes 6.

FIGS. 3, 4, 5 and 6 show the device embodying the invention in more detail.

For structural reasons, the device is formed by juxtaposing assemblies 15 which delimit the chutes 1 therebetween.

The chute 1 comprises a concave main sliding and deflecting surface 2 for letters. According to a first variant (FIGS. 4 and 5), this surface 2 is formed by a perforated metal sheet 7 having a film 8 of plastics or metallic material, preferably adhesive, on its face remote from the sliding face. In order to assist the sliding, the perforated metal sheet 7 is coated in its curved region A with polytetrafluoroethylene 9.

In a second variant (FIG. 6), the metal sheet 7 is provided with pits 7' formed by embossing. In this case a coating of polytetrafluoroethylene may likewise be provided in the curved region A.

A secondary surface 3 further delimits the chute 1. At the lower end of this secondary surface 3, 3' there is provided a flap 4, 4', hinged to the device about a transverse horizontal axis. This hinge is formed by pivot pins 16 fixed to L brackets 17 and pivoting in the walls in front of and behind each assembly 15. Moreover, these walls each have a section 18 provided with a sound deadening stop 19 of rubber, on which part of the bracket 17 abuts when the flap 4 is in its bottom position or is at its maximum inclination.

At the upper edge of the flap 4, 4' is located a mechanical sensor 10 with a tongue 20 applied to the flap 4, 4'. This sensor 10 provides the stop signal for stopping release of letters at this output unit when the flap 4, 4' is in its high position, inclined the least, corresponding to maximum filling of the box 6. The sensor 10 is fixed on the secondary surface 3, 3'.

On the inactive face of the main wall 2 there is fixed a photoelectric cell 11 which enables possible jamming of a letter exiting from the adjacent, non-associated chute to be detected. The light beam passes through the flap 4', provided with a hole, and is reflected near the end of the associated main surface 2'.

The flap 4 has its front and rear edges shaped, for example inclined, the minimum width of the flap being at its lower edge 5. Accordingly, on introducing a box 6, the rear wall of the latter slides along the front edge and pushes the flap up until it comes into position inside the box 6. Conversely, once the box 6 is full, it is withdrawn and the wall pushes the rear edge to disengage the box 6.

Operation of such a device is as follows:

A vertical letter is released above the chute 1 and slides on the main surface 2, where it is deflected.

It then comes into abutment with one of its edges against the flap 4, where it is braked and stabilized, any risk of lateral deviation of the letter being prevented.

The letter slides along the flap 4 and inserts itself over the letters already stacked in the box 6, by pivoting the flap 4 upwardly.

It should be noted that the trapezoidal shape of the flap 4 does not only allow it to lift automatically on inserting and removing the box 6 but also reduces its inertia by virtue of its "pointed" shape, which facilitates engagement of letters lightly under the flap 4.

Figures 3, 4, 5, 6:
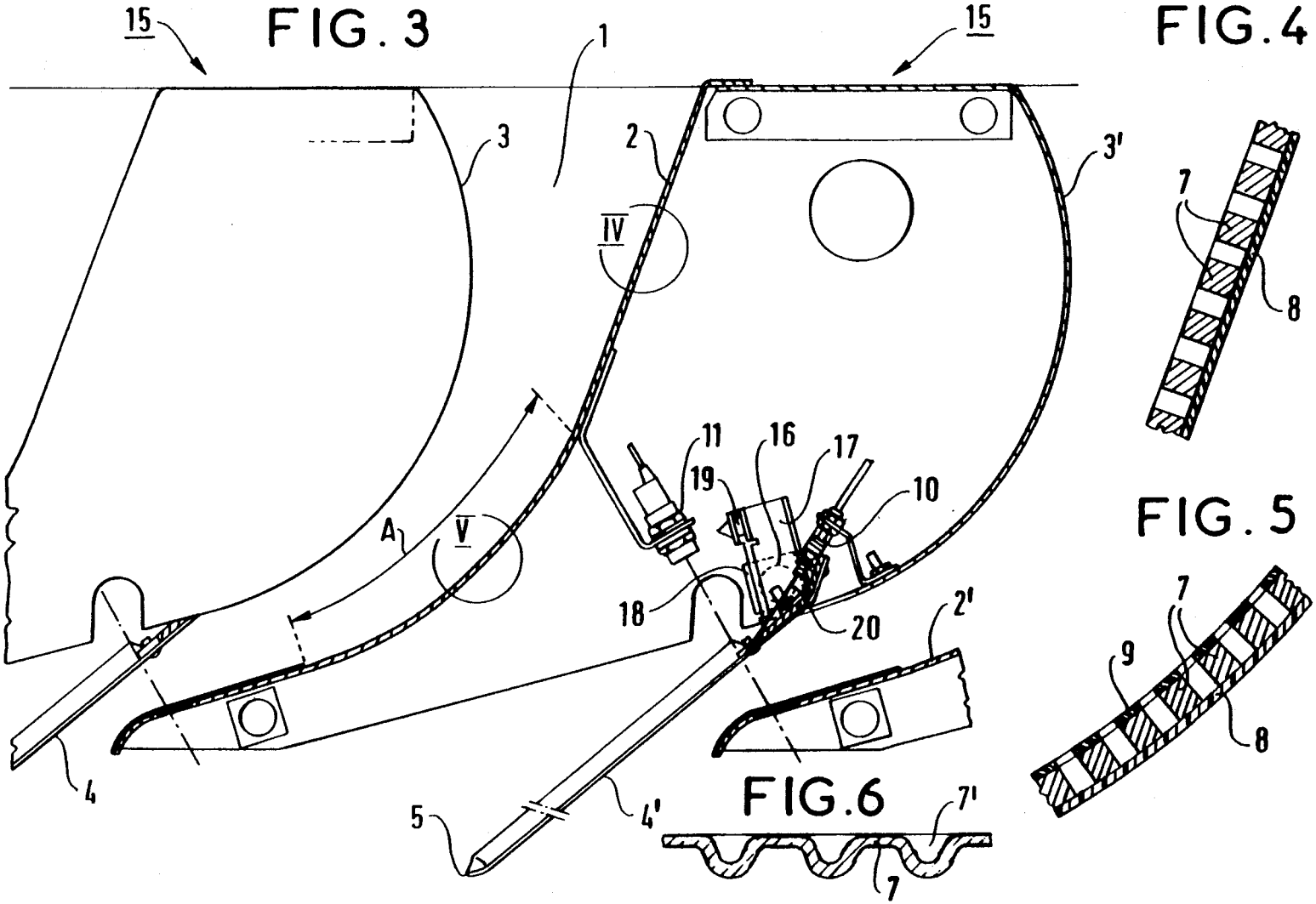
FIG. 3 is sectional view from the front of a device embodying the invention.
FIGS. 4, 5 and 6 are sectional views of details IV and V of FIG. 3.

By way of example, as is seen in FIG. 3, the main surface 2 is formed from top to bottom by a flat section inclined at about 70° to the horizontal, a curved region section with a radius of curvature of about 250 mm, a flat section of small inclination, and a convexly curved lip with a radius of curvature of about 40 mm.

We claim:

1. A device for inclining and stacking flat in a box, flat objects, especially letters exiting particularly from a sorting machine, in which the letters are fed vertically oriented and are released above the device, said device comprising a chute having a concave main slide and deflecting surface and an opposite, spaced, associated convex secondary surface, wherein the convex secondary surface is continued by a flap hinged about a transverse horizontal axis and having a lower edge thereof in contact with the letters stacked in the box, and wherein said main slide and deflecting surface is formed by a perforated metal sheet sealed on the back by a film.

2. A device according to claim 1, further comprising a photoelectric sensor detecting the presence of a letter at an output of the chute.

3. A device according to claim 2, wherein the film is of plastics material.

4. A device according to claim 2, wherein said photoelectric sensor is fixed on the convex side of the main slide and deflecting surface.

5. A device according to claim 1, wherein the metal sheet is at least partially coated on a side thereof facing said associated convex secondary surface with polytetrafluoroethylene.

6. A device for inclining and stacking flat in a box, flat objects, especially letters exiting particularly from a sorting machine, in which the letters are fed vertically oriented and are released above the device, said device comprising a chute having a concave main slide and deflecting surface and an opposite, spaced, associated convex secondary surface, wherein the convex secondary surface is continued by a flap hinged about a transverse horizontal axis and having a lower edge thereof in contact with the letters stacked in the box, and wherein said flap is a flat flap freely hinged to the secondary surface and has a stop position of maximum inclination in which said lower edge is adjacent the bottom of the box.

7. A device for inclining and stacking flat in a box, flat objects, especially letters exiting particularly from a sorting machine, in which the letters are fed vertically oriented and are released above the device, said device comprising a chute having a concave main slide and deflecting surface and an opposite, spaced, associated convex secondary surface, wherein the convex secondary surface is continued by a flap hinged about a transverse horizontal axis and having a lower edge thereof in contact with the letters stacked in the box, and wherein a mechanical tongue sensor is located adjacent the upper edge of the flap for tongue contact with said flap for detecting the maximum filling position of the box.

8. A device for inclining and stacking flat in a box, flat objects, especially letters exiting particularly from a sorting machine, in which the letters are fed vertically oriented and are released above the device, said device comprising a chute having a concave main slide and deflecting surface and an opposite, spaced, associated convex secondary surface, wherein the convex secondary surface is continued by a flap hinged about a transverse horizontal axis and having a lower edge thereof in contact with the letters stacked in the box, and wherein rear and front edges of the flap are shaped such that a minimum width of the flap is at the level of said lower edge, to form a lifting abutment edge acting against a rear wall of the box when the latter is removed or put in place.

9. A device for inclining and stacking flat in a box, flat objects, especially letters exiting particularly from a sorting machine, in which the letters are fed vertically oriented and are released above the device, said device comprising a chute having a concave main slide and deflecting surface and an opposite, spaced, associated convex secondary surface, wherein the convex secondary surface is continued by a flap hinged about a transverse horizontal axis and having a lower edge thereof in contact with the letters stacked in the box, and wherein the main slide and deflecting surface is formed by a perforated metal sheet sealed on the back by a film, and wherein the main slide and deflecting surface is formed by a metal sheet with embossed pits.

10. An output module comprising a plurality of aligned output units, each output unit comprising a device for inclining and stacking flat in a box, flat objects, especially letters exiting particularly from a sorting machine, in which the letters are fed vertically oriented and are released above the device, said device comprising a chute having a concave main slide and deflecting surface and an opposite, spaced associated convex secondary surface, and wherein said convex secondary surface is continued by a flap hinged about a transverse horizontal axis and having a lower edge thereof in contact with the letters stacked in the box, and wherein said main sliding and deflecting surface is formed by a perforated metal sheet sealed on the back by a film.

* * * * *